US008800761B2

(12) United States Patent
Lutzig et al.

(10) Patent No.: US 8,800,761 B2
(45) Date of Patent: Aug. 12, 2014

(54) CONTAINER FOR CONSUMER GOODS

(75) Inventors: Bodo-Werner Lutzig, Chavornay (DE); Yuzo Yamamoto, Tokyo (JP); Koko Ozono, Tokyo (JP)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 13/810,480

(22) PCT Filed: Jul. 18, 2011

(86) PCT No.: PCT/EP2011/062212

§ 371 (c)(1),
(2), (4) Date: Mar. 26, 2013

(87) PCT Pub. No.: WO2012/010540

PCT Pub. Date: Jan. 26, 2012

(65) Prior Publication Data

US 2013/0206617 A1 Aug. 15, 2013

(30) Foreign Application Priority Data

Jul. 19, 2010 (EP) ..... 10169994

(51) Int. Cl.
*B65D 5/18* (2006.01)

(52) U.S. Cl.
USPC ..... 206/268; 206/273

(58) Field of Classification Search
CPC ..... B65D 5/18; B65D 5/4266; B65D 5/6694; B65D 5/6691; B65D 85/1045
USPC ..... 206/268, 273, 259, 271; 229/160.1
See application file for complete search history.

(56) References Cited

U.S. PATENT DOCUMENTS 6,079,556 A * 6/2000 Draghetti et al. ..... 206/268
D503,827 S 4/2005 Cahill (Continued)

FOREIGN PATENT DOCUMENTS

CN 1217698 A 5/1999
DE 202 10 823 U1 9/2002

(Continued)

OTHER PUBLICATIONS

Communication Pursuant to Rule 114(2) EPC, for EP Application No. 11732481.4-1708 (PCT/EP2011/062212) dtd Feb. 25, 2013 (8 pgs).

(Continued)

*Primary Examiner* — Steven A. Reynolds
*Assistant Examiner* — King M Chu
(74) *Attorney, Agent, or Firm* — Mueting Raasch & Gebhardt P.A.

(57) ABSTRACT

The current invention relates to a container (1) comprising a wrapped bundle of consumer goods housed within a box wherein the box further comprises a box bottom wall (11), a first box side wall (101), a second box side wall (100), a box back wall (10) and a box front wall (10) and wherein the container further comprises a lid (13), wherein the lid is hingedly connected to the box across a hinge line, and wherein the lid further comprises a lid top wall, a first lid side wall, a second lid side wall, a lid back wall and a lid front wall (132), and wherein the container comprises at least one wavy surface (104*a*) bounded by two undulating outlines (102*a*, 103*a*) wherein the at least one wavy surface is arranged between two adjacent walls of the lid or two adjacent walls of the box, such that the at least one wavy surface at least partially bridges the two adjacent walls.

18 Claims, 6 Drawing Sheets

(56) References Cited

U.S. PATENT DOCUMENTS

Figure 1:
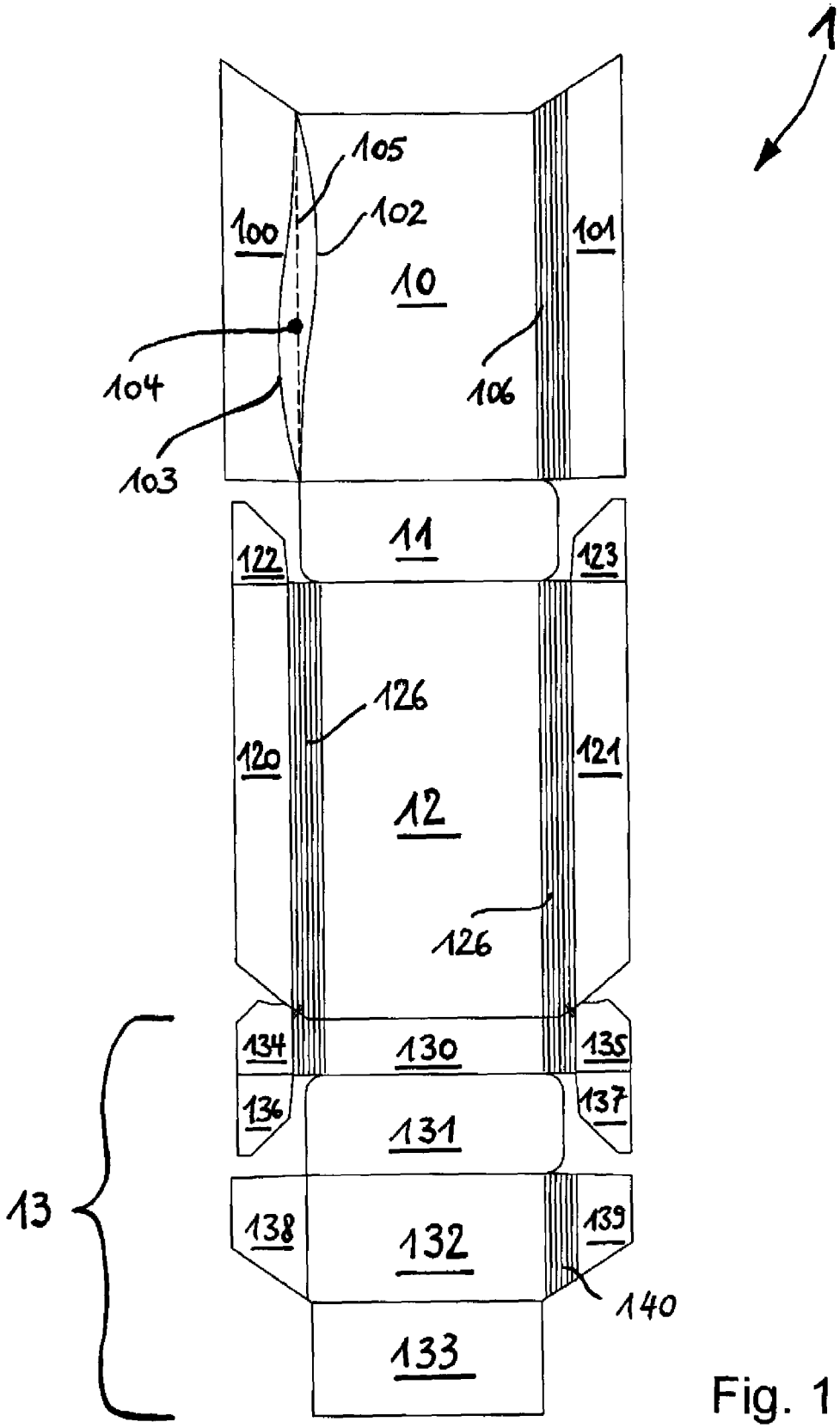

| | | | | |
|---|---|---|---|---|
| D607,318 | S * | 1/2010 | Collins | D9/423 |
| 2004/0035723 | A1 | 2/2004 | Franchini | |
| 2004/0144661 | A1 * | 7/2004 | Lutzig | 206/268 |

FOREIGN PATENT DOCUMENTS

| | | | |
|---|---|---|---|
| DE | 103 14 375 | A1 | 10/2004 |
| DE | 202004010230 | | 11/2004 |
| DE | 102008061661 | | 6/2010 |
| EP | 0 930 245 | | 7/1999 |
| EP | 1 927 548 | A1 | 6/2008 |
| GB | 942 748 | | 11/1963 |
| JP | 2004-515425 | | 5/2004 |
| JP | 2009-292515 | | 12/2009 |
| WO | WO 97/42098 | | 11/1997 |
| WO | 2010/066370 | | 6/2010 |

OTHER PUBLICATIONS

EP Extended Search Report dated Apr. 1, 2011, Application No. 10169994.0-2308.

PCT/EP2011/062212 Search Report and Written Opinion dated Mar. 30, 2012.

Official Action issued in Kazakhstan dated Jan. 6, 2014 for Application No. 2013/1519.1 (2 pages).

Official Action issued in Japan for Application No. 2013-520099 dated Mar. 3, 2014 (4 pages). English translation included.

Official Action issued in China for Application No. 201180035284.2 dated Apr. 10, 2014 (8 pages). English translation included.

* cited by examiner

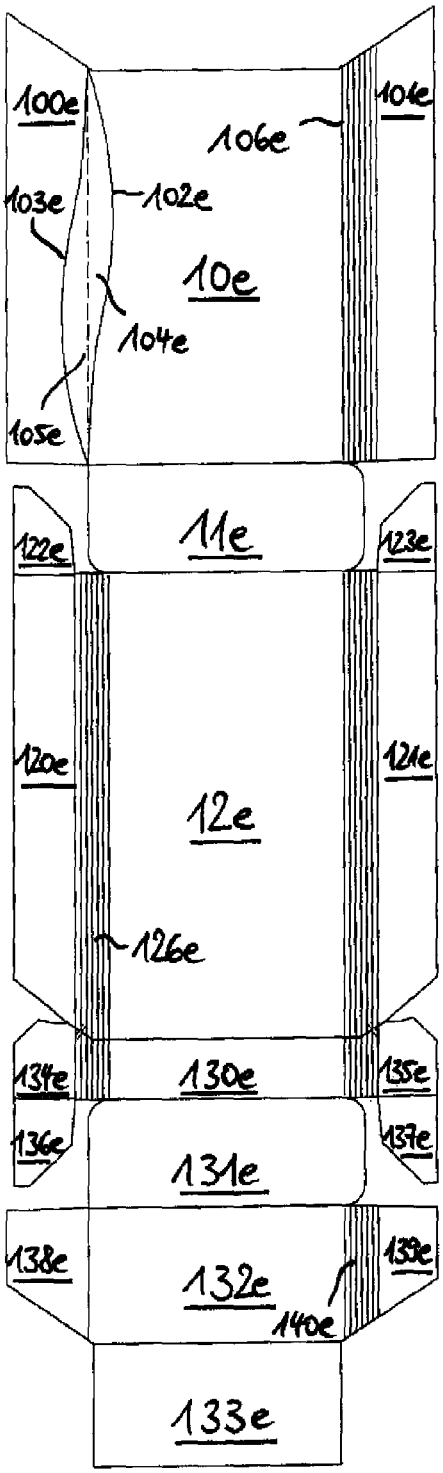
Fig. 10
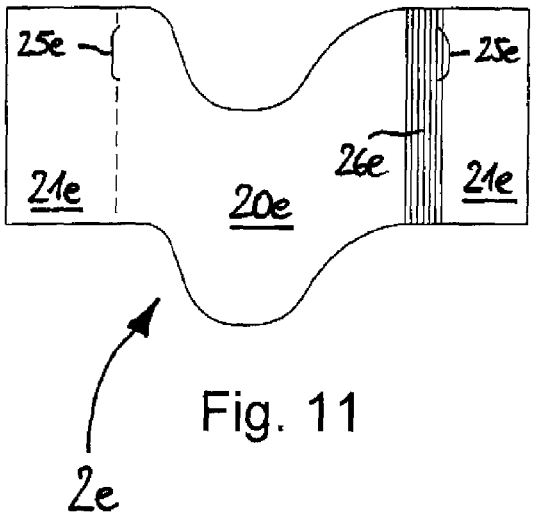
Fig. 11
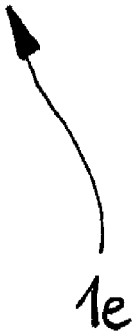

CONTAINER FOR CONSUMER GOODS

This application is a U.S. National Stage Application of International Application No. PCT/EP2011/062212, filed Jul. 18, 2011, which was published in English on Jan. 26, 2012 as International Patent Publication WO 2012/010540 A1, which is incorporated by reference in its entirety. International Application No. PCT/EP2011/062212 also claims priority to European Application No. 10169994.0, filed Jul. 19, 2010, which is incorporated by reference in its entirety.

The invention relates to a container for consumer goods.

Containers are particularly well-known in the field of packaging consumer goods, in particular smoking articles. Commonly, such containers have a substantially rectangular parallelepiped shape. Some of these containers known in the art also include longitudinal or transverse edges that are bevelled or rounded.

A container comprising a box having a bottom wall, first and second side walls, a back wall and a front wall, and a hingedly connected lid is known from DE-A-103 14 375. Bridging surfaces are arranged between the front wall and the respective adjacent side walls, as well as between the back wall and the respective adjacent side walls. The bridging surfaces are plane surface which include a fixed angle with the front wall and the respective side walls, or with the back wall and the respective side walls. The plane bridging surfaces are bounded by straight lines extending in the longitudinal direction of the box, so that the box has a polygonal shape.

In the field of packaging, it would be desirable to provide a rigid container which protects the consumer goods housed within the container and at the same time provide an interesting visual and tactile appearance. In this respect, it is a particular object of the invention to provide a container having a bridging surface which is twisted relative to the respective adjacently arranged walls. This is achieved with the container according to the present invention.

According to the present invention a container for consumer goods is provided comprising a box wherein the box further comprises a box bottom wall, a first box side wall, a second box side wall, a box back wall and a box front wall. The container further comprises a lid, wherein the lid is hingedly connected to the box across a hinge line, and wherein the lid further comprises a lid top wall, a first lid side wall, a second lid side wall, a lid back wall and a lid front wall.

The container further comprises at least one wavy surface bounded by two undulating outlines. The at least one wavy surface is arranged between two adjacent walls of the box or between two adjacent walls of the lid, such that the at least one wavy surface at least partially bridges the two adjacent walls.

Still further, the two undulating outlines bounding the wavy surface include a phase difference relative to each other.

The term "undulating outline" is used throughout the specification to refer to a wave like line that continuously changes its direction and has at least one concave section and one convex section. A preferable example for an undulating line is an "S-curve". Preferably, the two undulating outlines are substantially congruent with each other. Preferably, the two undulating outlines bordering the wavy surface are substantially point symmetric to the centroid of the wavy surface in the blank of the container, that is, where the wavy surface is flat and the container is not assembled. A preferred example for the undulating outline is a sinusoidal outline.

The two undulating outlines having the phase difference relative to each other allow for the formation of the desired twisted bridging surface. In this respect, the term "twisted" means that the direction of the normal to the bridging surface changes along the bridging surface. The phase difference generally may vary within the range of about 0 to 90 degrees (0 degrees excluded). Preferably, the phase difference varies within a range of about 30 to 90 degrees. More preferably, the phase difference varies within a range of about 45 to 90 degrees. Whenever the term "about" is used, this term is meant to also disclose and include the exact value, except for the value of 0 degrees.

The afore-described wavy bridging surface avoids the formation of a sharp edge thus making the container convenient to handle, and provides for an appealing visual and tactile appearance of the container. In particular, it allows for the formation of the desired twisted bridging surface.

Preferably, the distance between the two undulating outlines in the direction of the circumference changes continuously.

Preferably, the at least one wavy surface is provided between a front wall and one of the adjacent side walls. Since the wavy surface bounded by the undulating outlines contributes to the more attractive appearance of the container according to the invention, it is provided between the front wall and at least one of the side walls so that it is well visible for the consumer. In one particular embodiment of the container according to the invention, a wavy surface is provided between the front wall and each of the side walls.

Preferably, at least one first wavy surface is provided between two box walls and at least one second wavy surface is provided between two lid walls. Preferably, the at least one first wavy surface provided between two box walls and the at least one second wavy surface provided between two lid walls are aligned with each other. In this configuration, the closed container shows an interesting edge along the entire height, when the lid is aligned with the box portion. In that embodiment the undulating outlines on the box may coincide with the undulating outlines on the lid such that the wavy surfaces on the box and the lid appear to continue from the box to the lid when the container is closed.

Preferably, the container according to the invention further comprises a separate inner frame attached to the front wall of the body of the container. The said inner frame has an ear-like protrusion extending outwardly from the said inner frame for providing a snap-fit engagement for the lid as the lid is placed in the closed position. This is particularly advantageous in that the snap-fit engagement prevents an unintentional opening of the lid, and at the same time the "click" sound indicates to the consumer that the container is closed.

Preferably, the inner frame has at least one inner frame wavy surface bounded by two undulating outlines. The inner frame wavy surface is arranged between the inner frame front portion and an adjacent inner frame side portion. The inner frame wavy surface rest between the inner frame front portion and the respective adjacent inner frame side portion, and bridges the inner frame front portion and the adjacent inner frame side portion. This inner frame may complete the attractive appearance of the container which is improved by the wavy surface bounded by the undulating outlines. In particular, the inner frame may have a said wavy surface arranged between the inner frame front portion and a said adjacent inner frame side portion whenever there is a corresponding wavy surface arranged between the front wall and an adjacent side wall of the container.

Preferably, the container according to the present invention comprises two to five wavy surfaces arranged between the same two adjacent walls, that is, between a single first lid wall and a single second lid wall or between a single first box wall and a single second box wall.

Preferably, the least one wavy surface comprises between one and five undulations. This allows for a further variety of visual and tactile appearances of the container according to the invention.

Containers according to the invention may be in the shape of a rectangular parallelepiped, with right-angled longitudinal and right-angled transverse edges. Alternatively, the container may comprise in addition to the at least one wavy surface one or more rounded longitudinal edges, rounded transverse edges, bevelled longitudinal edges or bevelled transverse edges, or combinations thereof. For example, the container according to the invention may comprise, without limitation:

One or two longitudinal rounded or bevelled edges on the front wall, and/or one or two longitudinal rounded or bevelled edges on the back wall.

One or two transverse rounded or bevelled edges on the front wall, and/or one or two transverse rounded or bevelled edges on the back wall.

One longitudinal rounded edge and one longitudinal bevelled edge on the front wall, and/or one transverse rounded edge and one transverse bevelled edge on the back wall.

One or two transverse rounded or bevelled edges on the front wall and one or two longitudinal rounded or bevelled edges on the front wall.

Two longitudinal rounded or bevelled edges on a first side wall or two transverse rounded or bevelled edges on the second side wall.

Where the container comprises one or more rounded edges and is made from a laminar blank, preferably the blank comprises three, four, five, six or seven scoring lines or creasing lines to form each rounded edge in the assembled container. The scoring lines or creasing lines may be either on the inside of the container or on the outside of the container. Preferably, the scoring lines or creasing lines are spaced from each other by between about 0.3 mm and 4 mm.

Preferably, the spacing of the creasing lines or scoring lines is a function of the thickness of the laminar blank. Preferably, the spacing between the creasing lines or scoring lines is between about 0.5 and about 4 times larger than the thickness of the laminar blank.

Where the container comprises one or more bevelled edge, preferably the bevelled edge has a width of between about 1 mm and about 10 mm, preferably between about 2 and about 6 mm. Alternatively, the container may comprise a double bevel formed by three parallel creasing or scoring lines that are spaced such that two distinct bevels are formed on the edge of the container.

Alternatively, the container may have a non-rectangular transversal cross section, for example polygonal such as triangular or hexagonal, or oval, semi-oval, circular or semicircular.

Where the container comprises a bevelled edge and is made from a laminar blank, the bevel may be formed by two parallel creasing lines or scoring lines in the laminar blank. The creasing lines or scoring lines may be arranged symmetrically to the edge between a first wall and a second wall. Alternatively, the creasing lines or scoring lines may be arranged asymmetrically to the edge between the first wall and the second wall, such that the bevel reaches further into the first wall of the container than into the second wall of the container.

The container may be formed from any suitable materials including, but not limited to, cardboard, paperboard, plastic, metal, or combinations thereof. Preferably, the cardboard has a weight of between about 100 grams per square meter and about 350 grams per square meter.

Containers according to the invention may be used as packages for a variety of consumer goods. In a particularly preferred embodiment, containers according to the invention are used to package smoking articles. Containers according to the invention may be advantageously used to package smoking articles including, but not limited to, conventional lit-end cigarettes, cigars or cigarillos, heated smoking articles comprising a combustible fuel element or heat source and an aerosol-generating substrate (for example cigarettes of the type disclosed in U.S. Pat. No. 4,714,082) and smoking articles for use with electrical smoking systems (for example cigarettes of the type disclosed in U.S. Pat. No. 5,692,525).

Through an appropriate choice of the dimensions thereof, containers according to the invention may be designed to hold different total numbers of smoking articles, or different arrangements of smoking articles. For example, through an appropriate choice of the dimensions thereof, containers according to the invention may be designed to hold a total of between ten and thirty smoking articles.

The smoking articles may be arranged in different collations, depending on the total number of smoking articles. For example, the smoking articles may be arranged in a single row of six, seven, eight, nine or ten. Alternatively, the smoking articles may be arranged in two or more rows. The two or more rows may contain the same number of smoking articles. For example, the smoking articles may be arranged in: two rows of five, six, seven, eight, nine or ten; three rows of five or seven; or four rows of four, five or six. Alternatively, the two or more rows may include at least two rows containing different number of smoking articles to each other. For example, the smoking articles may be arranged in: a row of five and a row of six (5-6); a row of six and a row of seven (6-7); a row of seven and a row of eight (7-8); a middle row of five and two outer rows of six (6-5-6); a middle row of five and two outer rows of seven (7-5-7); a middle row of six and two outer rows of five (5-6-5); a middle row of six and two outer rows of seven (7-6-7); a middle row of seven and two outer rows of six (6-7-6); a middle row of nine and two outer rows of eight (8-9-8); or a middle row of six with one outer row of five and one outer row of seven (5-6-7).

Containers according to the present invention may hold smoking articles of the same type or brand, or of different types or brands. In addition, both filterless smoking articles and smoking articles with various filter tips may be contained, as well as smoking articles of differing length (for example, between about 40 mm and about 180 mm), diameter (for example, between about 4 mm and about 9 mm). In addition, the smoking articles may differ in strength of taste, resistance to draw and total particulate matter delivery. Preferably, the dimensions of the container are adapted to the length of the smoking articles, and the collation of the smoking articles. Typically, the outer dimensions of the container are between about 0.5 mm to about 5 mm larger than the dimensions of the bundle or bundles of smoking articles housed inside the container.

The length, width and depth of containers according to the invention may be such that, in the closed position, the resultant overall dimensions of the container are similar to the dimensions of a typical disposable hinge-lid pack of twenty cigarettes.

The exterior surfaces of containers according to the invention may be printed, embossed, debossed or otherwise embellished with manufacturer or brand logos, trade marks, slogans and other consumer information and indicia.

Where the inner housing of a container according to the present invention contains a bundle of cigarettes or other elongate smoking articles, the smoking articles are preferably wrapped in an inner liner of, for example, metal foil or metallised paper. The inner liner may be sealed or glued. Preferably, the inner liner comprises at least one access opening. Preferably, the inner liner further comprises a cover layer to close, open and recloses the access opening. This allows removing a consumer article from the inner liner and reclosing the inner liner after the removal of the consumer article. This may maintain the freshness of the consumer articles that remain within the inner liner.

Once filled, containers according to the invention may be shrink wrapped or otherwise over wrapped with a transparent polymeric film of, for example, polyethylene or polypropylene in a conventional manner. Where containers according to the invention are over wrapped, the over wrapper may include one or more tear tapes. The one or more tear tapes may extend in a transverse or longitudinal direction around the container.

Figure 2:
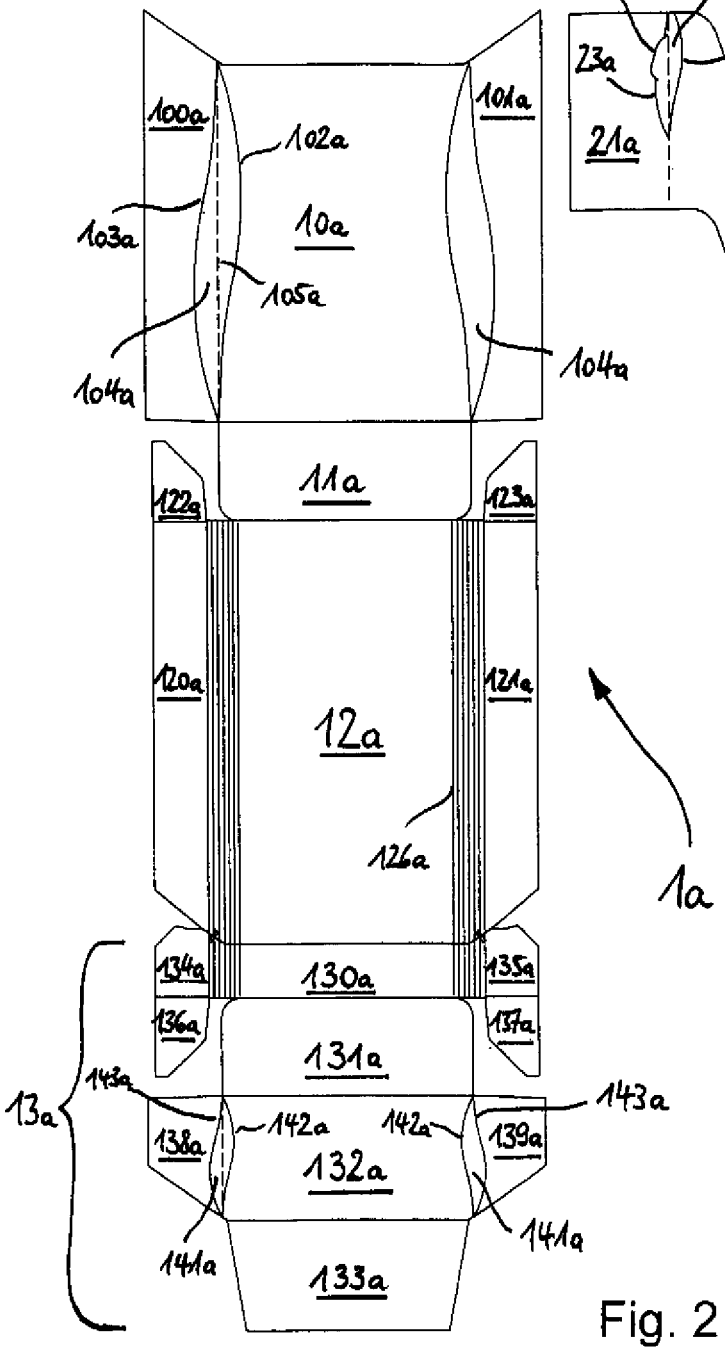
Figure 3:
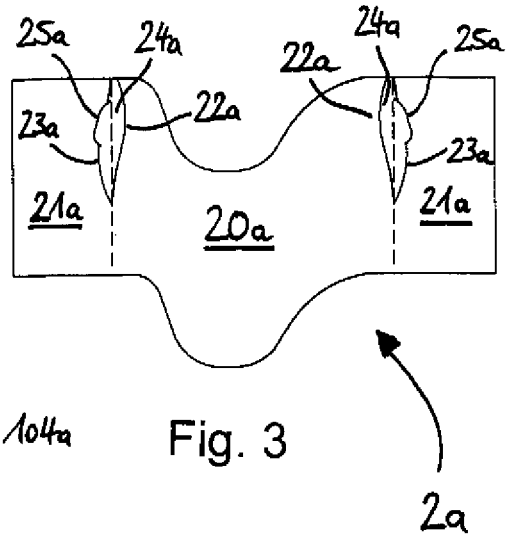
Figure 4:
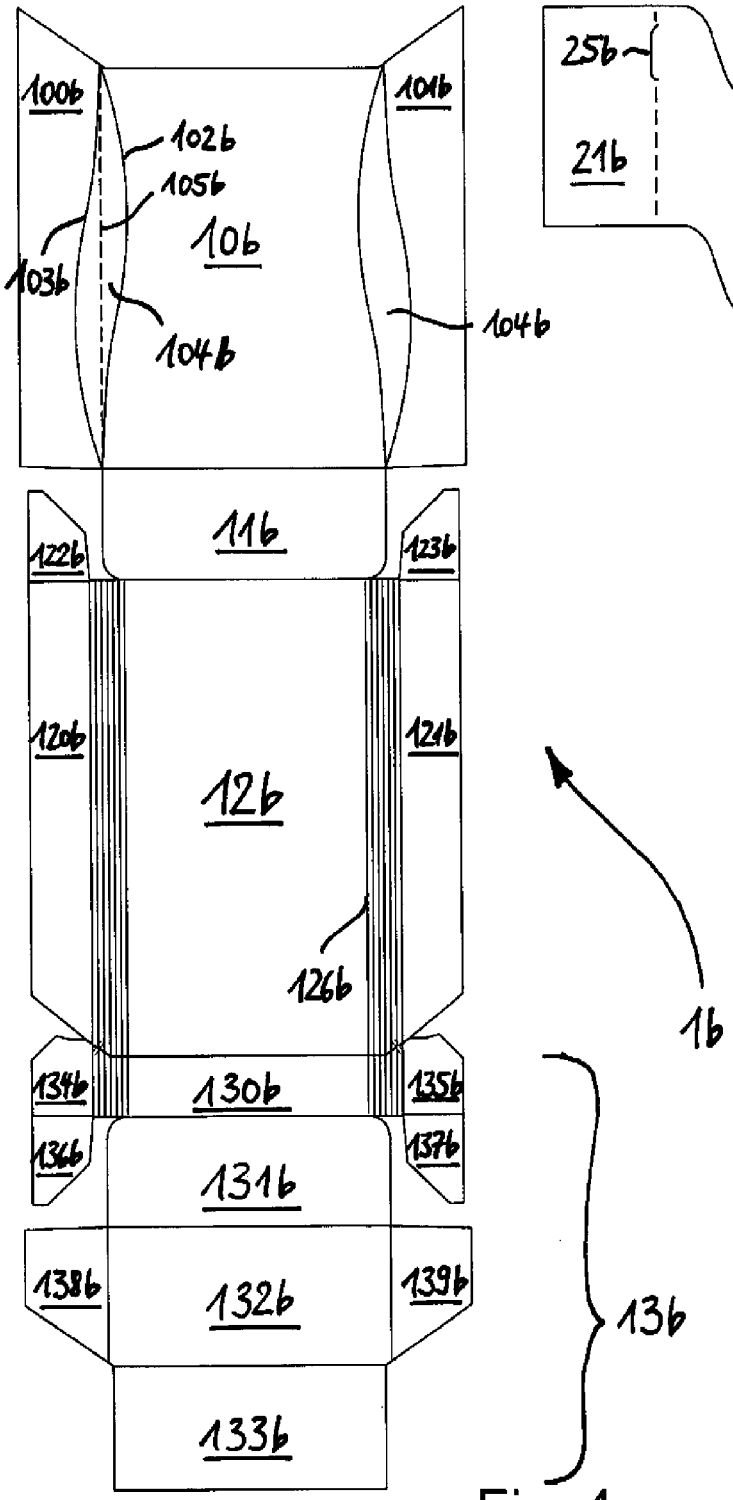
Figure 5:
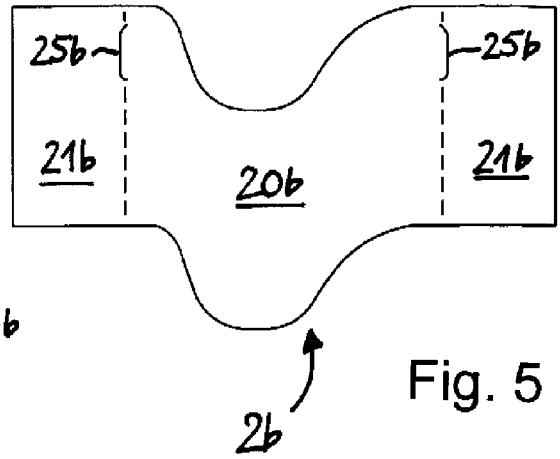
Figures 6, 7:
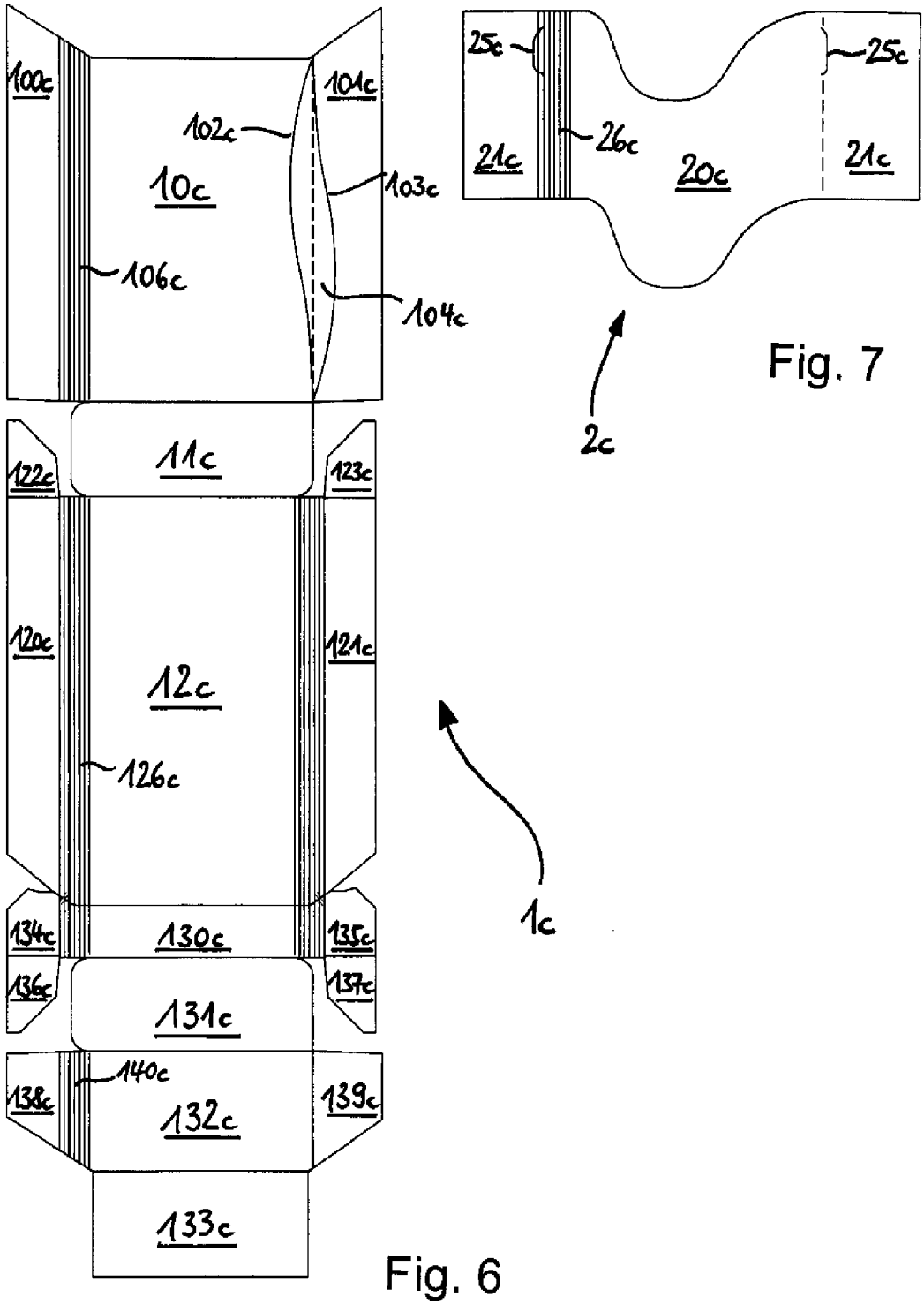
Figure 8:
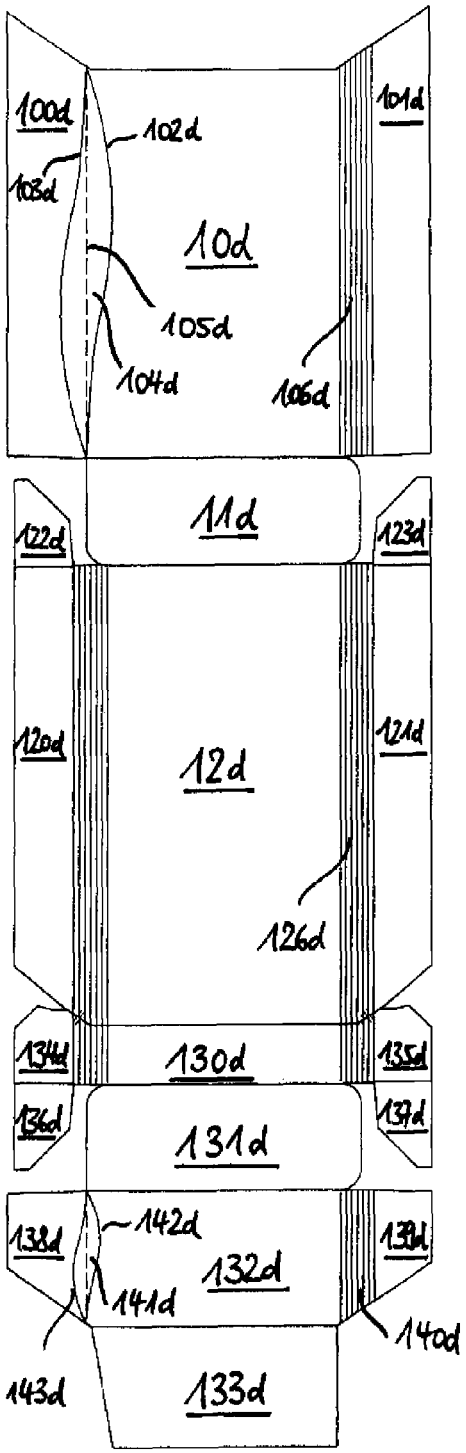
Figure 9:
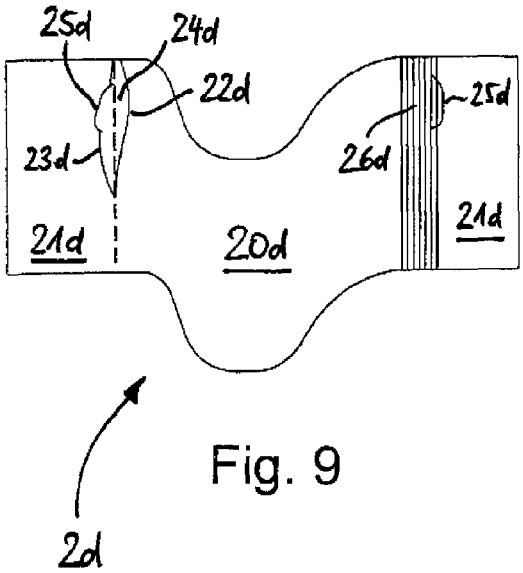

The invention will be described, by way of example only, with reference to the accompanying drawings in which:

FIG. 1 shows a cardboard blank of a first embodiment of the container according to the invention having one single wavy surface between the front wall and one side wall bounded by undulating outlines, FIG. 2 shows a second embodiment of a cardboard blank of a container according to the invention having a body with two wavy surfaces bounded by undulating outlines and a lid with two wavy surfaces bounded by undulating outlines, FIG. 3 shows an embodiment of an inner frame to be used together with the container of FIG. 2, the inner frame also having two wavy surfaces bounded by undulating outlines, FIG. 4 shows a third embodiment of a cardboard blank of a container according to the invention having a body with two wavy surfaces bounded by undulating outlines and a lid with no wavy surfaces, FIG. 5 shows an embodiment of an inner frame to be used together with a container of FIG. 4, the inner frame having no wavy surface, FIG. 6 shows a fourth embodiment of a cardboard blank of a container according to the invention having a body with one wavy surface bounded by undulating outlines and a lid with no wavy surface, FIG. 7 shows an embodiment of an inner frame to be used together with a container of FIG. 6, the inner frame having no wavy surface, FIG. 8 shows a fifth embodiment of a cardboard blank of a container according to the invention having a body with one wavy surface and a lid with one wavy surface, FIG. 9 shows an embodiment of an inner frame to be used together with a container of FIG. 8, the inner frame having one wavy surface, FIG. 10 shows a sixth embodiment of a cardboard blank of a container according to the invention having a body with one wavy surface and a lid with no wavy surface, and FIG. 11 shows an embodiment of an inner frame to be used together with a container of FIG. 10, the inner frame having no wavy surface.

In FIG. 1 a first embodiment of a cardboard blank of a first embodiment of the container according to the invention is shown. The cardboard blank is one single piece of cardboard material which can be folded and glued so as to form the container. A separate blank for an inner frame is provided which is to be glued to the box front wall and the box side walls. As can be seen the container 1 represented by its cardboard blank has only one single wavy surface between the front wall and one side wall bounded by undulating outlines, as will become apparent from the following description.

In the following description the terms "front", "back", "upper", "lower", "side", "top", "bottom" and other terms used to describe relative positions of the components of containers according to the invention refer to the container in an upright position with the lid at the top end and the hinge on the back. When describing containers according to the present invention, these terms are used irrespective of the orientation of the container being described.

The terms "left" and "right" are used with reference to side walls of the container when the container is viewed from the front in its upright position. The term "longitudinal" refers to a direction from bottom to top or vice versa. The term "transverse" refers to a direction perpendicular to the longitudinal direction.

Container 1 or its cardboard blank, respectively, comprises a box front wall 10, a box bottom wall 11, a box rear wall 12, two box side walls formed by box side wall portions 100,101 and 120,121 after having been attached together, and a lid 13. Lid 13 comprises a lid rear wall 130, a lid top wall 131, and a lid front wall formed by folding lid flap 133 by 180 degrees towards the inside of the lid rear along the folding line between walls 132,133 and gluing it to portion 132.

Folding and gluing of the cardboard blank to form the container 1 may be performed as follows: the first, left box side wall 100 is bent towards the rear along undulating outline 102 on the box front wall 10 and along undulating outline 103 on the box side wall 100, so that a twisted wavy surface 104 is formed which is bounded by undulating outlines 102,103. This wavy surface 104 extends in the longitudinal direction of box front wall 10 and box side wall 100 and bridges box front wall 10 and left box side wall 100, similar to a chamfer. Dashed line 105 is shown to indicate the position where normally the sharp edge between box front wall 10 and left box side wall 100 is arranged. A second, right box side wall 101 is bent towards the rear along bending lines 106 so as to form a rounded edge.

Left dust flap 122 is bent towards the rear along the folding line between itself and side wall 120, and right dust flap 123 is bent towards the rear along the folding line between itself and side wall 121. Folding of box side walls 120,121 towards the rear along bending lines 126 then results in that dust flaps 122,123 extend inwardly. Box rear wall 12 is then bent along the folding line between itself and box bottom wall 11, and box bottom wall 11 is subsequently bent along the folding line between itself and box front wall 10 and box bottom wall 11. Box rear wall 12 then extends parallel to box front wall 10.

In this state, left box side walls 100,120 as well as right box side walls 101,121 overlap in a manner such that box side walls 100,101 form the outermost walls of the box side walls. Inwardly extending dust flaps 122,123 overlap the inner surface of box bottom wall 11. Dust flaps 122,123 are then glued to the inner surface of box bottom wall 11, and inner surface of box side walls 100,101 are glued to outer surfaces of box side walls 120,121 to form the box side walls of container 1. Assembly of the body of the container 1 is then finished.

Assembly of the lid 13 is performed in a similar manner: lid dust flap 136 is folded towards the rear along the folding line between itself and side wall 134. Correspondingly, lid dust flap 137 is folded towards the rear along the folding line between itself and side wall 135. Side wall 138 is folded towards the rear along the folding line between itself and front wall 132, and side wall 139 is also folded towards the rear along bending lines 140 to form a rounded edge.

As side walls 134,135 are folded towards the rear this results in flaps 136,137 extending inwardly. As already described above, 133 has already been folded towards the rear and glued to lid front wall 132. The so obtained lid front wall 132,133 is then folded towards the rear along the folding line between lid front wall 132 and lid top wall 131, and lid top wall 131 is folded towards the rear along the folding line between itself and rear 130.

In this state, inwardly extending flaps 136,137 are glued to the inner surface of lid top wall 131. Also, side walls 138,134 and side walls 135,139 overlap in a manner such that side walls 138,139 form the outermost side walls. The outer surface of side wall 134 is then glued to the inner surface of side wall 138, and correspondingly the outer surface of side wall 135 is glued against the inner wall of side wall 139. The hinge of the lid is then formed by the folding line between lid rear wall 130 and box rear wall 12.

Alternatively, the container may be formed by assembling it around a bundle of smoking articles, starting from the box rear wall 12 and folding up box side walls 120, 121 and lid side walls 134, 135. Then the dust flaps 122, 123, 136, 137 are folded around the top and bottom of the cigarette bundle. Then glue is applied to the side walls 120, 121, 134 and 135 and to the dust flaps 122, 123, 136, 137. Then the box bottom wall 11 is folded up and attached to the box dust flaps 122 123. Then the lid top wall 131 is folded up and attached to the lid dust flaps 136, 137. At some time before the next step the lid flap 133 has been folded inward and attached to the inside of the lid front wall 132. Then the box front wall 10 and the lid front wall 132 are folded onto the bundle of smoking articles. As a last step the box side walls 100, 101 are folded down and attached to the side walls 120, 121 such that the box side walls 100, 101 overlie the box side walls 120 and 121. Likewise, the lid side walls 138, 139 are folded down and attached to the lid side walls 134, 135 respectively such that the lid side walls 138, 139 overlie the lid side walls 134, 135.

Having performed these steps container 1 is essentially ready, depending on whether or not it is to be equipped with an inner frame, as will be described further below in connection with other embodiments. Accordingly, in the following description of further embodiments, like parts have been assigned like reference numbers, with a letter from "a" to "e" has been added for each specific embodiment. However, assembly of the respective embodiments of the container will not be described in detail, since this is performed in the same manner as described above. Therefore, as regards assembly of these embodiments of the container according to the invention, it is referred to the description of the embodiment of FIG. 1.

In FIG. 2 a second embodiment of a cardboard blank of the container according to the invention is shown. The cardboard blank is one single piece of cardboard material which can be folded and glued so as to form the container 1*a*, except for the inner frame 2*a* (see FIG. 3). The inner frame is a separate piece of for example cardboard which is glued to the inner walls of the folded and glued cardboard blank so as to form container 1*a*.

Container 1*a* or its cardboard blank, respectively, comprises a box front wall 10*a*, two side walls 100*a*,101*a*, two wavy surfaces 104*a* bounded by undulating outlines 102*a*, 103*a*, respectively, and a box bottom wall 11*a*. Container 1*a* further comprises a box rear wall 12*a*, two further box side walls 120*a*, 121*a*, and a lid 13*a*. Lid 13*a* comprises a lid rear wall 130*a*, a lid top wall 131*a*, and a lid front wall formed by folding lid flap 133*a* towards the rear along the folding line between walls 132*a*,133*a* and gluing it to lid front wall 132*a*. Lid 13*a* further comprises two wavy surfaces 141*a* bounded by undulating outlines 142*a*,143*a*.

The remaining flaps of the cardboard blank have been assigned like numbers as in the embodiment of FIG. 1 with the letter "a" having been added.

As has already been mentioned, once the cardboard blank has been folded and glued in the manner described above, inner frame 2*a* is attached to the assembled cardboard blank.

Inner frame 2*a* comprises a front portion 20*a*, and two lateral portions 21*a*. In addition, there are two wavy surfaces 24*a* bounded by undulating outlines 22*a*,23*a*, these wavy surfaces 24*a* being arranged between inner frame front portion 20*a* and the respective inner frame side portion 21*a*. As can be seen, there is provided an ear-like protrusion 25*a* extending outwardly from one of the undulating boundary lines 22*a*,23*a* at the respective inner frame side portions.

After having folded inner frame 2*a* along folding lines 26*a* in the lower half of inner frame 2*a* and along undulating outlines 22*a*,23 in the upper half of inner frame 2*a*, the outer surfaces of inner frame side portions 21*a* are glued against the inner surfaces of the side walls of the folded and glued cardboard blank in a manner such, that at least the wavy surfaces 24*a* bounded by the undulating outlines 22*a*,23*a* project beyond the upper boundary of box front wall 10*a*, and that the ear-like protrusions 25*a* are arranged above the upper boundary of the side walls of the folded and glued cardboard blank. Accordingly, the lower parts of inner frame front portion 20*a* and of inner frame side portions 21*a* are glued to the inner surface of box front wall 10*a* and to the inner surfaces of the side walls of the folded and glued cardboard blank.

Once the inner frame 2*a* has been glued to the folded and glued cardboard blank, upon closing lid 13*a* the lid side walls 138, 139 slide over ear-like protrusions 25*a* so as to form a kind of a very loose snap fit, the closing being indicated by a "click" noise as the side walls of lid 13 slide over ear-like protrusions 25*a*. The snap fit is such that lid 13*a* can be easily opened in the conventional manner by pivoting lid 13*a* about its hinge.

Alternatively to the assembly sequence described above, in a first step the inner frame 2*a* is placed onto the front face of a bundle of smoking articles and the inner frame side portions 21*a* are bent down around the bundle of smoking articles. In a next step the container is assembled around the bundle of smoking articles as described above with the addition that glue is applied to the inner frame such that the inner frame side portions 21*a* are attached to the box side walls 120*a*, 121*a* and the inner frame front portion 20*a* is attached to the inside of the box front wall 10*a*.

A third embodiment of the container 1*b* according to the invention or its cardboard blank, respectively, is shown in FIG. 4, with the corresponding inner frame 2*b* being is shown in FIG. 5. Again, like parts are assigned like reference numbers, however, the letter "b" being added for this embodiment. Essentially, the third embodiment of the container 1*b* differs from the embodiment shown in FIG. 2 and FIG. 3 in that the lid 13*b* does not have any wavy surfaces. This applies to the inner frame 2*b*, too.

A fourth embodiment of the container 1*c* according to the invention or its cardboard blank, respectively, is shown in FIG. 6, with the corresponding inner frame 2*c* being shown in FIG. 7. Again, like parts are assigned like reference numbers, however, the letter "c" being added for this embodiment. Essentially, the fourth embodiment of the container differs in that it has only one wavy surface 104*c* between box front wall 10*c* and side wall 101*c*, and it that neither the lid 13*c* nor the inner frame 2*c* has any such wavy surface. Instead, inner frame 2*c* is provided with bending lines 26*c* provided between fronts 20*c* and lateral 21*c* at the location where there are provided corresponding bending lines 106*c* between box front wall 10*c* and left box side wall 100*c* of the cardboard blank.

A fifth embodiment of the container 1*d* according to the invention or its cardboard blank, respectively, is shown in FIG. 8, with the corresponding inner frame 2*d* being shown in FIG. 9. Again, like parts are assigned like reference numbers, however, the letter "d" being added for this embodiment. Essentially, the fourth embodiment of the container differs in that it has only one wavy surface 104*d* between box front wall 10*d* and left box side wall 100*d*, and it that the lid 13*d* has one corresponding wavy surface 141*d* and the inner frame 2*d* also has one such corresponding wavy surface 24*d* between front 20*d* and the corresponding lateral 21*d*. In addition, inner frame 2*d* is provided with bending lines 26*d* provided between front 20*d* and the other lateral 21*d* at the location where there are provided corresponding bending lines 106*d* between box front wall 10*d* and box side wall 101*d* of the cardboard blank. As to the manner how to assemble the cardboard blank and the inner frame it is referred to the description of the assembly of the cardboard blank and the inner frame above.

A sixth embodiment of the container le according to the invention or its cardboard blank, respectively, is shown in FIG. 10, with the corresponding inner frame 2*e* being shown in FIG. 11. Again, like parts are assigned like reference numbers, however, the letter "e" being added for this embodiment. The sixth embodiment shown in FIG. 10 and FIG. 11 corresponds essentially to the fourth embodiment shown in FIG. 6 and FIG. 7. The differences are that the wavy surface 104*e* and the bending lines 106*e* are arranged between the front surface 10*e* and the respective other lateral surface 100*e*. Further, the bending lines 26*e* of inner frame 2*e* as well as the bending lines 140*e* of the lid 13*e* are arranged correspondingly.

The invention claimed is:

1. Container comprising a box, wherein the box further comprises a box bottom wall, a first box side wall, a second box side wall, a box back wall and a box front wall; and wherein the container further comprises a lid, wherein the lid is hingedly connected to the box across a hinge line, and wherein the lid further comprises a lid top wall, a first lid side wall, a second lid side wall, a lid back wall and a lid front wall; and wherein the container comprises at least one wavy surface bounded by two undulating outlines wherein the at least one wavy surface is arranged between two adjacent walls of the lid or two adjacent walls of the box, such that the at least one wavy surface at least partially bridges the two adjacent walls, and wherein the two undulating outlines bounding the wavy surface include a phase difference relative to each other; and wherein the container further comprises a separate inner frame attached to the box front wall, and wherein the inner frame comprises at least one inner frame wavy surface bounded by two inner frame undulating outlines which is arranged between the box front wall and an adjacent box side wall of the inner frame and bridges the box front wall and the adjacent box side wall of the inner frame.

2. Container according to claim 1, wherein the distance between the two undulating outlines in the direction of the circumference of the box changes continuously.

3. Container according to claim 1, wherein the at least one wavy surface is provided between the box front wall and one of the box side walls.

4. Container according to claim 1, wherein at least one first wavy surface bounded by two undulating outlines is provided between two box walls and at least one second wavy surface is provided between two lid walls.

5. Container according to claim 4, wherein the at least one first wavy surface bounded by two undulating outlines provided between two box walls and the at least one second wavy surface bounded by two undulating outlines provided between two lid walls are aligned with each other.

6. Container according to claim 1, wherein said inner frame having an ear-like protrusion extending outwardly from the said inner frame for providing a locking engagement for the lid as the lid is closed.

7. Container according to claim 1, wherein the inner frame comprises at least one inner frame wavy surface bounded by two inner frame undulating outlines arranged between the front wall and a box side wall whenever there is a corresponding wavy surface arranged between the box front wall and a box side wall.

8. Container according to claim 1, wherein the container comprises two to five wavy surfaces arranged between the same two adjacent walls.

9. Container according to claim 1, wherein the least one wavy surface comprises between one and five undulations.

10. Container according to claim 1, wherein the container comprises smoking articles.

11. Container according to claim 2, wherein the at least one wavy surface is provided between the box front wall and one of the box side walls.

12. Container according to claim 2, wherein at least one first wavy surface bounded by two undulating outlines is provided between two box walls and at least one second wavy surface is provided between two lid walls.

13. Container according to claim 12, wherein the at least one first wavy surface bounded by two undulating outlines provided between two box walls and the at least one second wavy surface bounded by two undulating outlines provided between two lid walls are aligned with each other.

14. Container according to claim 2, wherein said inner frame having an ear-like protrusion extending outwardly from the said inner frame for providing a locking engagement for the lid as the lid is closed.

15. Container according to claim 14, wherein the inner frame wavy surface is bounded by two undulating outlines arranged between the front wall and a box side wall whenever there is a corresponding wavy surface arranged between the box front wall and a box side wall.

16. Container according to claim 2, wherein the container comprises two to five wavy surfaces arranged between the same two adjacent walls.

17. Container according to claim 2, wherein the least one wavy surface comprises between one and five undulations.

18. Container according to 2, wherein the container comprises smoking articles.

* * * * *